United States Patent [19]

Hann et al.

[11] Patent Number: 4,950,641

[45] Date of Patent: Aug. 21, 1990

[54] THERMAL TRANSFER PRINTING DYESHEET AND BACKCOAT COMPOSITION THEREFOR

[75] Inventors: Richard A. Hann; Barry Pack, both of Ipswich, England

[73] Assignee: Imperial Chemical Industries PLC, London, England

[21] Appl. No.: 262,745

[22] Filed: Oct. 26, 1988

[30] Foreign Application Priority Data

Oct. 30, 1987 [GB] United Kingdom ..... 8725452

[51] Int. Cl.[5] ..... B41M 5/035; B41M 5/26

[52] U.S. Cl. ..... 503/227; 428/195; 428/480; 428/483; 428/488.4; 428/500; 428/913; 428/914

[58] Field of Search ..... 428/195, 484, 488.1, 428/488.4, 913, 914, 480, 483, 500; 503/227

[56] References Cited

FOREIGN PATENT DOCUMENTS 138483 4/1985 European Pat. Off. ..... 503/227

*Primary Examiner*—Pamela R. Schwartz

*Attorney, Agent, or Firm*—Cushman, Darby & Cushman

[57] ABSTRACT

For a thermal transfer dyesheet, a protective backcoat is provided by polymerizing acrylic functional groups in a composition comprising: an organic resin comprising at least one polyfunctional material having a plurality of pendant or terminal acrylic groups per molecule available for cross-linking, at least 10% by weight of the polyfunctional material having 4–8 such acrylic groups per molecule; at least one linear organic polymer soluble or partially soluble in the resin, and comprising 1–40% by weight of the resin/polymer mixture; a slip agent selected from derivatives of long chain carboxylic or phosphoric acids, long alkyl chain esters of phosphoric acid, and long alkyl chain acrylates; an antistatic agent soluble in the resin, and a solid particulate anti-blocking agent less than 5 μm in diameter.

Resins having predominently 5–7 acrylic functional groups per molecule, are preferred for enhancing protection against the thermal head, especially when used in a mixture also containing molecules having only 2–4 such acrylic groups per molecule. The effect of using such mixtures to cross link molecules of both high and low acrylic functionalities in the presence of the linear polymers, is to enable good thermal protection to be provided by a durable low friction coating, which also cleans the thermal head during printing.

10 Claims, No Drawings

THERMAL TRANSFER PRINTING DYESHEET AND BACKCOAT COMPOSITION THEREFOR

The invention relates to thermal transfer printing in which one or more dyes are caused to transfer from a dyesheet to a receiver sheet in response to thermal stimulae applied to selected areas of the dyesheet by a thermal printer head, and in particular to dyesheets for such printing processes.

Dyesheets generally consists essentially of a thermoplastic substrate film supporting on one surface, at least a dyecoat containing a thermal transfer dye, and often also a subbing layer to improve adhesion. The substrate film is usually polyester film, such as "Melinex" polyethyleneterephthalate film (manufactured by Imperial Chemical Industries PLC), although other polymers such as polyamides have also been proposed.

During printing, heat is applied to selected areas of the other surface of the substrate film by the printer head, the heat travelling through the substrate to transfer dye from corresponding areas of the dyecoat to a receptive surface held adjacent to the dyecoat. Dyesheets are most conveniently used in the form of an elongated strip, eg rolled up in a cassette, so that when making a plurality of prints, the strip may be moved forward in print-size increments after each print has been made. The dyecoats are usually uniform in thickness and colour, but for multicolour printing, uniform areas of different primary colours may be provided in sequence along the roll so that each colour in turn can be transferred to the same receiver sheet. Individual letters and numbers are printed by heating only those areas where dye transfer is required, pictures similarly being built up pixel by pixel. To achieve this the sheets are held against a printer head having a row of very closely spaced tiny heaters, each heater providing a single pixel. When each row has been thus printed, the printer head and dyesheet are moved relatively, to enable the next row to be printed, and the sequence repeated until the whole picture is built up, row by row.

However, for high resolution printing at high speed, it is necessary to provide the thermal stimulus in pulses of very short duration to enable all the rows to be printed sequentially within an acceptably short time, but this in turn requires higher temperatures in the printer head in order to provide sufficient thermal energy to transfer sufficient dye in the time allowed. Typically such temperatures are well in excess of the softening or melting temperature of the thermoplastic substrate. One effect of such high temperatures can be localised adhesion between the substrate film and the printer head, manifesting itself in the resulting print as visible faults, such as ribs of varying colour density lying transverse to the direction of travel of the sheets past the printer head. Printing may be accompanied by a series of clicks as the sheets are repeatedly stuck to, then freed from, the apparatus, becoming a chatter-like noise at higher frequencies. In severe cases the base film can lose its integrity.

In the past, these problems have been addressed by providing the dyesheet with protective backcoats of highly cross-linked high-slip polymers, including, for example, silicon-containing compounds such as siloxanes and silicones, or wax-containing cross-linked resins. These can be effective in maintaining the integrity of the base film and reducing ribbing where the conditions are very clean, but we have now found that when they are used in a normal working environment exposed to dust, hair and other air-borne debris, the high release properties of such coatings allow debris settling on them to become collected on the printer head rather than be carried away by the dyesheet. This can also lead to degradation of the print quality in the form of streaking in the direction of travel, or even complete pixel failure in the printer head, leading to lines on the print in the direction of travel. Unfortunately, merely reducing the slip/release properties can lead to higher friction, which in turn can also promote ribbing faults.

The presence of silicones in the backcoat can also lead to other problems. When dyesheets having silicone-containing backcoats have been rolled up and stored for any length of time, eg in a cassette, such that the backcoat of one portion of the dyesheet is held against the dyecoat of another portion, we have evidence of migration and crystallisation of the dye, leading to degradation of any prints eventually made using that dyesheet.

We have now devised a back-coat composition of selected resins, polymers and additives, which minimises contamination of the printer head while obtaining protection against heat-induced faults.

Accordingly a first aspect of the invention provides a dyesheet for thermal transfer printing, comprising a thermoplastic substrate film supporting on one surface, at least a dyecoat containing a thermal transfer dye, and having a polymeric back-coat on the other surface, wherein the back-coat consists essentially of a reaction product of polymerising acrylic functional groups in a layer of a coating composition comprising:

(a) an organic resin comprising at least one polyfunctional material having a plurality of pendant or terminal acrylic groups per molecule available for cross-linking, at least 10% by weight of the polyfunctional material having 4–8 such acrylic groups per molecule;

(b) at least one linear organic polymer soluble or partially soluble in the resin, and comprising 1–40% by weight of the resin/polymer mixture;

(c) a slip agent selected from derivatives of long chain carboxylic or phosphoric acids, long alkyl chain esters of phosphoric acid, and long alkyl chain acrylates;

(d) an antistatic agent soluble in the resin, and (e) a solid particulate antiblocking agent less than 5 μm in diameter.

Any two or more of the above components a–e may be provided by a single material where applicable. Thus for example, a salt of a long chain carboxilic acid remaining in the coating as particles less than 5 μm in diameter, can act as both slip agent (component c) and antiblocking agent (component e), and long alkyl chain acrylates having more than one functional acrylic group and used as slip agents (component c) can also provide a polyfunctional material in the resin (component a).

A second aspect of the present invention provides a coating composition for use in the manufacture of dyesheets for thermal transfer printing, the composition comprising the components a–e of the first aspect of the invention and (f) activation means responsive to thermal or optical stimulus for effecting polymerisation of the acrylic functional groups.

A third aspect of the present invention provides a process for manufacturing dyesheets for thermal transfer printing, comprising coating one surface of a thermoplastic substrate film with at least a dyecoat composition and coating the other surface with a composition of the second aspect of the invention, thereafter applying the stimulus for effecting polymerisation of the acrylic functional groups.

When the acrylic functional groups have been polymerised, the cross-linked polyfunctional materials provide the backcoat with improving hardness and thermal properties as the number of acrylic functional groups per molecule increases, thereby reducing the risk of adhesion to the hot print head during printing. Compositions which do not have any molecules with 4 or more acrylic functional groups do not produce particularly enhanced thermal properties; but conversely increasing amounts of polyfunctional materials having more than about 8 such functional groups per molecule, while leading to coatings having very good thermal properties, also lead increasingly to lack of flexibility. In extreme cases this can result in pieces of the backcoat flaking off if the dyesheet is creased or otherwise distorted. On the basis of these findings we prefer to restrict at least the bulk of our resins to materials with acrylic functionalities of 8 or less.

Even resins having acrylic functionalities within the range 4–8, would not on their own provide satisfactory backcoats. They rely on the other specified components of the coating composition to temper the effect of such high functionalities on, for example, the flexibility of the crosslinked material. Thus in those compositions according to the present invention in which all the molecules have acrylic functionalities in the range 4–8, it is the effect of the linear organic polymer (component "b") which enables the superior thermal properties of such resins to be harnessed in a uniform coating of adequate flexibility. However, we have also found that an even more useful balance of properties can be obtained by polymerising such high functionality materials in the presence of resins of lower acrylic functionality, with which they react for form a much cross-linked matrix when the acrylic moeties are polymerised. These lower functionality resins are added in addition to the linear polymers of component "b", which latter component is believed to remain entwined in the crosslinked matrix rather than be chemically bonded into it, at least throughout most of its length.

Our preferred composition is thus one in which the polyfunctional organic resin comprises a mixture of organic molecules each having a plurality of the pendant or terminal acrylic groups, at least 10% by weight of the polyfunctional material has 2–4 such acrylic groups per molecule and at least 10% by weight of the polyfunctional material has 5–7 such acrylic groups per molecule.

Increasing the proportion of the lower acrylic functionality material leads to a more flexible coating, but too high a proportion will lead to increasingly poor thermal resistance. In general we prefer to use compositions in which at least 50% by weight of the polyfunctional material has 5–7 such acrylic groups per molecule. This can provide compositions having a good balance of thermal properties and flexibility, without undue increase in surface friction.

The polyfunctional materials preferably comprise molecules having oligomer backbones selected from urethanes, epoxides and polyesters, to which the acrylic groups are attached. Where compounds of appropriately high acrylic functionalities are available, polyacrylated alkyl chains can also be used to good effect. The acrylic groups may include methacrylic groups.

The polyfunctional materials of component a may themselves be in the form an organic liquid, or more usually the resin may also include a solvent. As the coating composition has to be capable of being applied as an even coating onto the substrate film, it is desirable for the linear organic polymer (component b) to be completely soluble in the resin. However, we find that this is not essential providing that any emulsion formed by partially immiscible components is sufficiently stable to retain good dispersion throughout the coating process. Several of the mixtures described hereinafter tend to be hazy, indicating incomplete solubility, yet provide a smooth and effective backcoat when dried and polymerised.

Examples of polyvalent materials suitable for use in component a include Ebecryl 600 (a straight epoxy acrylate oligomer having 2 functional acrylic groups per molecule), Sartomer SR 200 (a long alkyl chain (C14/C15) diacrylate manufactured by Sartomer International Inc.), Ebecryl 264 (an aliphatic urethane acrylate having 3 functional acrylic groups per oligomer, dissolved in hexandiol diacrylate as an 85% solution). Ebecryl 810 (a polyester acrylate oligomer having a functionality of 4) and Ebecryl 220 (a straight aromatic urethane acrYlate oligomer having a functionality of 6). Ebecryl resins are manufactured by UCB (chemicals sector). Speciality Chemicals Division, B-1620 Drogenbos, Belgium.

Optically curable resins having a short cure time are preferred, to enable in-line curing to be effected. For these the activator means (component f) includes sensitiser systems responsive to radiation of appropriate wavelength, this for most known systems being UV radiation. Examples of such systems include Quantacure ITX and Quantacure EPD (both from Ward Blenkinsop), Irgacure 907 (from Ciba Geigy) and Uvecryl P101 (from UCB), and mixtures thereof. Sensitiser systems have also been developed recently for acrylic resins which can be used with radiation of visible wavelengths, thus avoiding the hazards associated with UV light.

Preferred linear organic polymers of component b are polymethylmethacrylate, polyvinyl chloride, linear polyester and acrylated polyester polyols. Examples include Diakon LG 156 polymethylmethacrylate (from ICI PLC), Corvic CL5440 vinyl chloride/vinyl acetate copolymer (from ICI PLC), Ebecryl 436 linear polyester (supplied as 40% solution in trimethylolpropane triacrylate by UCB) and Synacure 861X hydroxy functional acrylated polyester. All of these consists of linear molecules essentially free from functional acrylic groups, and are believed to remain entwined in the crosslinked matrix but not chemically bonded into it. We have found, however, that some acrylic functionality can be present in the linear polymer, although anything other than very small quantities may have an adverse effect on the polymerisation reaction. An example of such materials is Macromer 13K-RC, a polystryl methacrylate manufactured by Sartomer International Inc. with a molecular weight quoted by the manufacturers as 13000.

An effect of the linear organic polymer is to increase the viscosity of the coating composition and thereby assist in the laying down of a uniform coating layer. We find it also improves adhesion of the cured coating to the thermoplastic substrate film, and modifies various properties of the cured coating. For example, improved flexibility may be obtained more readily by the presence of the linear polymer than by adding the lower functionality resins, but this is generally at the expense of higher friction values. The minimum quantity of linear polymer required depends largely on the polyfunctional resins used, but too much can lead to too soft a backcoat. This in turn can lead to noisy printing as the dyesheet temporarily adheres to the print head and resists moving on for printing of the next row.

Preferred slip agents are salts of stearic and hydroxy stearic acids, e.g. their lithium soaps, and especially salts of polyvalent metals and stearic acids, e.g. zinc stearate. Stearyl acrylate has also provided good results as a slip agent. Examples of polymerised derivatives of long alkyl carboxylic acids include polyvinyl stearate and polyvinyl behanate. Examples of suitable phosphoric esters include Gafac RD 510 (from GAF Corporation) and Plysurf A 208s, both being mixed long-chain alkyl acid esters of phosphoric acid. Both esters also have some antistatic properties and can be used to provide both slip and antistatic functions (components c and d respectively), but we prefer generally also to provide a specific antistatic agent. Other known lubricants, e.g. waxes such as Ceridust 3910 and Lancowax TF 1778, however, have proved unsuitable in this composition, causing sticking of the printer head, as shown by a very noisy operation, generally with a loud chattering sound.

When used in the present compositions, none of the selected slip agents specified have been found to produce the above-described problems previously attributed to the presence of silicones in the backcoat. An effective amount of the present slip agents can be as little as 1% by weight of the resin, and more than 15% is generally unnecessary and hence uneconomic. About 5% is generally suitable, the amount being uncritical.

Suitable antistatic agents include ATMER 129 (from ICI PLC), and generally these may be used in amounts as specified by their manufacturers, 0.1 to 10%, e.g. 1%, generally being effective amounts for most products.

The backcoat should be very thin, just sufficient to provide the protective and head cleaning functions described herein; typically less than 5 μm, most suitably about 1 μm. It is for this reason that the antiblocking additive needs to be small. Larger particles can cause problems, presumably due to their standing proud of the surface and possibly also becoming dislodged. Whatever the reason, we have found that in the present compositions fine materials having a plate-like structure give the best results. Preferred antiblocking additive is fine talc.

A preferred dyesheet also has a dye-barrier layer between the dyecoat and the thermoplastic substrate film, thereby to reduce the amount of dye moving towards the printer head during the printing operation. Preferred barrier coats comprise the mixtures of acrylic polyfunctional resins and linear polymers of the present backcoat, likewise cross-linked via the functional acrylic groups.

Our preferred process according to the third aspect of the invention is a continuous in-line process comprising the steps of passing a length of substrate film through a coating apparatus, coating a surface of the moving film with a layer of coating composition of the second aspect of the invention containing as activator means a radiation-responsive sensitiser system, drying the composition, and subjecting the coating to radiation appropriate to effect curing of the composition as the film continues to move through the coating apparatus.

The invention is illustrated by the following Examples, of which Examples 5, 6, 8, 9, 11 and 12 are provided for comparative purposes, their compositions being outside the scope of this invention.

In each of the following Examples the polyfunctional acrylates and linear polymers are designated by the trade name under which they were obtained, the descriptions given being those supplied by the manufacturers. The talc and particulate slip agents were air jet milled and air classified to be less than 5 μm particle diameter with an average particle size of about 2 μm. The solid materials, both soluble and insoluble, were then dissolved in resin/solvent mixture using a high shear mixer (Silverson/Greaves) for 10–15 min, being made up in methyl isobutyl ketone to give a viscosity of 20–25 s Zahn 2 cup.

This backcoat was coated by gravure onto 6 μm thick polyester base film to give a coating layer about 2 μm thick while still wet. This was then solvent stripped in an oven equipped with high velocity air knives, and then irradiated with UV light on a heated drum at a temperature below the Tg of the linear polymer used (typically 80° C. when using Diakon LG 156), using a single 200 watt/in medium pressure mercury lamp as UV source, at a machine speed of 10–50 m/min. This gave an exposure time to the UV radiation of only about 0.1–0.5 s, and to effect the cure, a sensitiser system (as activation means f) was added to the composition, consisting of 2% Quantacure ITX (from Ward Blenkinsop),
2% Quantacure EPD (from Ward Blenkinsop),
4% Irgacure 907 (from Ciba Geigy), and
4% Uvecryl P101 (from UCB), where the percentages are by weight based on the weight of the resins used. This was added to the composition at the mixing stage in the high shear mixer.

On the other side of the base film was applied a barrier layer comprising 70 parts by weight of Ebecryl 220, 10 parts by weight of Diakon LG 156, and 20 parts by weight of Synocure 861X, sensitised and UV cured as for the backcoat, and covered with a dyecoat of thermally transferable dye in a polymer binder. The dyesheet thus produced consisted of the following layers: dyecoat, barrier layer, polyester base film and backcoat. This barrier layer was found to have an efficient barrier action preventing dye diffusion backwards into the polyester base film when printing, thereby enhancing the printing density obtained.

The dyesheets thus prepared were placed adjacent to a receiver sheet and passed through a printer. The printer head used was a Kyocera KMT 85, having 6 pixels per mm. Head pressure at the printing point was 6 kg with a platten Shore hardness of 40–45. Maximum print power was 0.32 watt/dot, and signals of various strengths within the range were applied to the printer head within the available range.

Printing using each of the dyesheets in turn was assessed by the following subjective evaluations:

1. Ribbing—irregular spacing of the printer lines, which shows as lines of different density appearing transverse to the printing direction. This is usually associated with high melt bonding of the backcoat to the printer head after a row of pixels has been printed.
2. Streaking—white lines (or coloured lines in the case of full colour image printing), usually diffuse, lying in the direction of printing. This is considered to be caused by debris collecting on the printer head, causing an air gap between the printer head and the dyesheet.

3. Noise during printing—irregular or regular clicking as the sheet moves on, chattering. This is also associated with melt bonding of the backcoat to the head.

Dynamic, static and melt-bonding frictions were also measured for each composition.

The compositions prepared had the following formulations, the quantities being by weight:

EXAMPLE 1

76 parts Ebecryl 600 (acrylic functionality ("AF")=2)
10 parts Ebecryl 220 (AF=6)
14 parts Synocure 861X (acrylated polyester polyol, AF=0)
5 parts zinc stearate
1 part Atmer 129
5 parts talc

EXAMPLE 2

76 parts Ebecryl 600
10 parts Ebecryl 220
14 parts Synocure 861X
5 parts stearyl acrylate
1 part Atmer 129
5 parts talc

EXAMPLE 3

76 parts Ebecryl 600
10 parts Ebecryl 220
14 parts Synocure 861X
5 parts lithium stearate
1 part Atmer 129
5 parts talc

EXAMPLE 4

76 parts Ebecryl 600
10 parts Ebecryl 220
14 parts Synocure 861X
5 parts lithium hydroxy stearate
1 part Atmer 129
5 parts talc

EXAMPLE 5

43 parts Ebecryl 600 (AF=2)
23 parts Ebecryl 264 (AF=3)
20 parts Ebecryl 220 (AF=6)
2 parts Ebecryl 360 (silicone acrylate, AF=6)
12 parts Diakon LG 156 (polymethylmethacrylate)
5 parts talc

EXAMPLE 6

80 parts Ebecryl 600
20 parts Corvic CL 5440 (PVC/PVA)
3 parts Ceridust 3910 (wax)
4 parts Atmer 129
5 parts talc

EXAMPLE 7

43 parts Ebecryl 600
43 parts Ebecryl 220
14 parts Diakon LG 156
5 parts Plysurf A 208S (complex phosphate ester)
1 part Atmer 129
5 parts talc

EXAMPLE 8

43 parts Ebecryl 600
43 parts Ebecryl 220
2 parts Ebecryl 360
12 parts Diakon LG 156
5 parts talc

EXAMPLE 9

43 parts Ebecryl 600
43 parts Ebecryl 220
14 parts Diakon LG 156
5 parts Lancowax TF 1778 (wax)
1 part Atmer 129
5 parts talc

EXAMPLE 10

43 parts Ebecryl 810 (AF =4)
43 parts Ebecryl 220 (AF =6)
14 parts Diakon LG 156
5 parts zinc stearate
1 part Atmer 129
5 parts talc

EXAMPLE 11

43 parts Ebecryl 220
2 parts Ebecryl 360 (silicone)
12 parts Diakon LG 156
43 parts Ebecryl 436 (linear polyester)
5 parts talc

EXAMPLE 12

41 parts Ebecryl 220
18 parts Diakon LG 156
41 parts Synocure 861X
5 parts zinc stearate
1 part Atmer 129
3 parts talc

EXAMPLE 13

26 parts Ebecryl 600
60 parts Ebecryl 220
14 parts Diakon LG156
5 parts zinc stearate
1 part Atmer 129
5 parts talc

EXAMPLE 14

26 parts Ebecryl 810
60 parts Ebecryl 220
14 parts Diakon LG156
5 parts zinc stearate
1 part Atmer 129
5 parts talc

EXAMPLE 15

26 parts Ebecryl 600
60 parts Ebecryl 220
10 parts Synocure 861X
4 parts Diakon LG156
5 parts zinc stearate
1 part Atmer 129
5 parts talc Results of the tests described above on each of the above compositions are given in Tables 1 to 4 which follow, and are summarised in the subsequent paragraphs.

Examples 1–4 all have a high proportion of low functionality in the resin, giving softer, less brittle resins than the higher functionality resins, but the balance of resins to linear polymers is kept high (>7) to give only traces of noise and ribbing, as shown in Table 1. The stearate slip agents of Examples 1–4 also allow contaminants to adhere to the backcoat, and thus are self cleaning with respect to the printer head. This is evidenced by the total absence of any visible streaking. Even deliberate contamination of the backcoat did not lead to streaking of the printed image. However, when silicones were added (Example 5), although no ribbing was seen with the high release materials, this same high-release property caused contamination to remain preferentially on the printer head, giving rise to severe streaking problems. This problem was found to be only marginally improved when the silicone was replaced by a wax (Example 6), but this made the ribbing and noise problems more severe.

TABLE 1

| | | Example | | | | | |
|---|---|---|---|---|---|---|---|
| | | 1 | 3 | | 4 | 5 | 6 |
| Ribbing | | intermittent | traces @ | traces @ | traces @ | none | continuous |
| pulse width ms | | | 7, 8 ms | 7 ms | 7, 8 ms | | from 3 ms |
| Streaking | | none | none | none | none | severe | moderate |
| Noise | | none | traces @ | traces @ | traces @ | moderate | severe |
| pulse width ms | | | 2,10 ms | 2, 10 ms | 2, 10 ms | | |
| Friction: | dynamic | 49–55 | 110 | 71 | 88 | not-tested | 60 |
| g @ 12 m/s | static | 68–75 | 119 | 94 | 105 | not-tested | 150 |
| | melt | 20–24 | 27 | 33 | 30 | not-tested | 91 |

TABLE 2

| | | Example | | |
|---|---|---|---|---|
| | | 7 | 8 | 9 |
| Ribbing | | traces @ | traces @ | traces |
| pulse width ms | | 8 ms | 7, 8 ms | irregular |
| streaking | | none | severe | none |
| Noise | | very slight | traces @ | severe |
| pulse width ms | | @7, 8 ms | 8, 9, 10 ms | |
| Friction: | dynamic | 59 | 51–71 | 47 |
| g @ 12 m/s | static | 57 | 59–75 | 60 |
| | melt | 7 | 9–14 | 16 |

The composition of Example 7 has a more even balance between low and high acrylic functionalities. This gives a slightly harder but more brittle coating. Again the effect of adding silicones (Example 8) is to cause severe streaking while retaining good resistance to ribbing. Using a wax (Example 9) again gives very good protection against streaking at the expense of severe noise.

TABLE 3

| | | Example | | |
|---|---|---|---|---|
| | | 10 | 11 | 12 |
| Ribbing | | traces @ | moderate @ | severe |
| pulse width ms | | 7–8 ms | 2–4 ms | 3–10 ms |
| streaking | | none | severe | traces |
| Noise | | traces @ | severe | severe |
| pulse width ms | | 3, 7–10 ms | | |
| Friction: | dynamic | 60 | not tested | 52–58 |
| g @ 12 m/s | static | 64 | not tested | 105–123 |
| | melt | 10 | not tested | 56–64 |

This table deals with the harder coating having a higher proportion of high acrylic functionality in the resin. While the composition of the invention (Example 10) gives a good allround performance. The silicone (Example 11) again gives rise to severe streaking. This backcoat is also softened by having a higher proportion of linear polymer than polyfunctional resin, leading also to severe noise, (in the other two tables the resin/-polymer ratios were all according to the present invention). This is found also in Example 12, where it is exacerbated by the use of a wax slip agent instead of the selected slip agents of the invention. The use of wax, however, can again be seen to have removed the debris from the printer head, leading to streaking properties about as low as in the Example 10 composition of the invention.

TABLE 4

| | | Example | | |
|---|---|---|---|---|
| | | 13 | 14 | 15 |
| Friction: | dynamic | 52 | 45 | 44 |
| (g @ 12 m/s) | static | 53 | 48 | 45 |
| | melt | 6.5 | 7.7 | 6.5 |

This table shows the consistantly low friction values obtained using resins having a higher percentage of molecules with acrylic functionalities of 5–8, i.e. according to our preferred compositions.

The following examples are provided to illustrate the effects of changing selected individual components of the composition.

EXAMPLE 16

70 parts Ebecryl 600
27 parts Corvic CL5440
3 parts Ebecryl 360
1 part Atmer 129
5 parts talc This example had no resin of high AF value, and gave a coating of very good flexibility but white streaking in the printed image was very noticeable.

Friction: dynamic 99 g;
melt 9.3 g.

EXAMPLE 17

86 parts Ebecryl 810
14 parts Diakon LG156
5 parts zinc stearate
1 part Atmer 129
5 parts talc The composition in this example has only resins of intermediate AF value, and compares directly with Examples 10 and 14, in each of which resin of AF value 6 was also present, their friction test results being given in Table 5 below. Printing with dyesheets coated according to this exanple was noisy at 1–3 m/s, quiet at 4–9 m/s, and very noisy at 10 m/s. Severe ribbing occured at 4–8 m/s but less severe at 9 and 10 m/s.

TABLE 5

| | | Example | | |
|---|---|---|---|---|
| | | 17 | 10 | 14 |
| Friction: | dynamic | 42 | 60 | 45 |
| (g @ 12 m/s) | static | 70 | 64 | 48 |
| | melt | 27 | 10 | 7.7 |

EXAMPLE 18

86 parts Ebecryl 220
14 parts Diakon LG156

5 parts zinc stearate 1 part Atmer 129

5 parts talc

This composition used only high AV value resin (AV=6), and gave a dyesheet that printed quietly with no ribbing. In Table 6 the good friction values are compared with results obtained in other examples.

TABLE 6

| | | Example | | |
|---|---|---|---|---|
| | | 18 | 13 | 7 |
| Friction: | dynamic | 39 | 52 | 59 |
| (g @ 12 m/s) | static | 47 | 53 | 57 |
| | melt | 9 | 6.5 | 7 |
| Ebecryl 220/600 ratio | | 86/0 | 60/26 | 43/43 |

EXAMPLE 19

80 parts Ebecryl 220 (AF=6)
15 parts Sartomer SR 2000 (AF=2)
5 parts Corvic CL 5440
5 parts zinc stearate
1 part Atmer 129
5 parts talc

EXAMPLE 20

80 parts Ebecryl 220 (AF=6)
15 parts Sartomer SR 2000 (AF=2)
5 parts Corvic CL 5440
5 parts zinc stearate
1 part polyvinylidene fluoride
1 part Atmer 129
5 parts talc The two resin components in Examples 19 and 20 were found not to be compatible on their own, but in the presence of the Corvic, they formed a clear stable solution, with no phase separation. This composition had a good viscosity for gravure printing, and gave a good quality coating. The results of the friction tests are given in Table 7.

TABLE 7

| | | Example | |
|---|---|---|---|
| | | 19 | 20 |
| Friction: | dynamic | 50 | 56 |
| (g @ 12 m/s) | static | 50 | 56 |
| | melt | 1.0 | 0 |

EXAMPLE 21

60 parts Ebecryl 220
20 parts Ebecryl 600
14 parts Mowital B 30 HH (polyvinyl butyral)
5 parts zinc stearate
1 part Atmer 129
5 parts talc

EXAMPLE 22

60 parts Ebecryl 220
20 parts Ebecryl 600
14 parts Mowital B 60 HH (polyvinyl butyral)

5 parts zinc stearate 1 part Atmer 129

5 parts talc

EXAMPLE 23

60 parts Ebecryl 220
20 parts Ebecryl 600
14 parts Corvic 5440
5 parts zinc stearate
1 part Atmer 129
5 parts talc These three compositions differed in the linear polymer used for component "b". The composition of Examples 21 and 22 gave dyesheets which printed quietly, but adhesion of these backcoats to the thermoplastic substrate film was poor, especially that using B 30 HH. That using Corvic CL5440 as the linear polmer gave very quiet printing with very good adhesion. The results of the friction tests are given in Table 8.

TABLE 8

| | | Example | | |
|---|---|---|---|---|
| | | 21 | 22 | 23 |
| Friction: | dynamic | 53 | 50 | 71 |
| (g @ 12 m/s) | static | 65 | 60 | 79 |
| | melt | 15 | 14 | 13 |

EXAMPLE 24

50 parts Ebecryl 220
50 parts IRR 71 (see below)
5 parts zinc stearate
1 part Atmer 129
5 parts talc IRR 71 is a mixture of tetraethylene glycol diacrylate and triethylene glycol diacrylate. This composition contained no linear polymer and gave poor quality coatings by gravure (the coating method used in all these examples). However, adhesion of the polymerised coating was good.

The results of the friction tests at 7 m/s were:
dynamic 65 g;
static 78 g;
melt 16 g.

EXAMPLE 25

66.5 parts Ebecryl 220
28.5 parts Ebecryl 600
5 parts reactive polymer, Macromer 13K-RC 5
5 parts zinc stearate
1 part Atmer 129
5 parts talc

EXAMPLE 26

60 parts Ebecryl 220
26 parts Ebecryl 600
5 parts reactive polymer, Macromer 13K-RC 5

5 parts zinc stearate
1 part Atmer 129
5 parts talc

Macromer 13k-RC is a polystyryl methacrylate (MW 13,000). Printing in the former case was slightly noisy, and in the latter printing was noisy above 7 m/s. Adhesion was good in both cases. The results of the friction tests are given in Table 8.

EXAMPLE 27

60 parts Ebecryl 220
26 parts polyethylene glycol 1000 dimethacrylate
5 parts reactive polymer, Macromer 13K-RC
5 parts zinc stearate
1 part Atmer 129
5 parts talc Printing was quiet, with no ribbing.

TABLE 8

| | | Example | | |
|---|---|---|---|---|
| | | 25 | 26 | 27 |
| Friction: | dynamic | 74 | 68 | 79 |
| (g @ 12 m/s) | static | 78 | 77 | 93 |
| | melt | 9 | 15 | 13 |

EXAMPLE 28

76 parts Ebecryl 600
10 parts Ebecryl 220
14 parts Synocure 861X
5 parts zinc stearate
1 part Atmer 129
5 parts talc Example 29

76 parts Ebecryl 600
10 parts Ebecryl 220
14 parts Synocure 861X
5 parts zinc stearate
1 part Atmer 129

The effect of omitting the talc was most pronounced on non-hot release friction (dynamic), apparently due to surface roughness characteristics and their effect on the print head/backcoat blocking.

TABLE 10

| | | Example | |
|---|---|---|---|
| | | 28 | 29 |
| Friction: | dynamic | 35 | 65 |
| (g @ 12 m/s) | static | 48 | 65 |
| | melt | 14 | 14 |

We claim:

1. A dyesheet for thermal transfer printing, comprising a thermoplastic substrate film supporting on one surface a dyecoat containing a thermal transfer dye, and having a polymeric back-coat on the other surface, wherein the back-coat consists essentially of a reaction product of polymerising acrylic functional groups in a layer of a coating composition comprising:

(a) a polyfunctional organic resin having a plurality of pendant or terminal acrylic groups per molecule available for cross-linking, at least 10% by weight of the polyfunctional resin having 4–8 such acrylic groups per molecule;
(b) at least one linear organic polymer soluble or partially soluble in the resin, and comprising 1–40% by weight of the resin/polymer mixture;
(c) a slip agent selected from salts and esters of long chain carboxylic, hydrocarboxylic and phosphoric acids, long alkyl chain esters of phosphoric acid, and long alkyl chain acrylates;
(d) an antistatic agent soluble in the resin, and
(e) a solid particulate antiblocking agent less than 5 μm in diameter.

2. A dyesheet as claimed in claim 1, in which at least 10% by weight of the polyfunctional resin has 2–4 such acrylic groups per molecule and at least 10% by weight of the polyfunctional resin has 5–7 such acrylic groups per molecule.

3. A dyesheet as claimed in claim 2, in which at least 50% by weight of the polyfunctional resin has 5–7 acrylic functional groups per molecule.

4. A dyesheet as claimed in any one of the preceding claims, in which the polyfunctional resin comprises molecules having oligomer backbones selected from urethanes, epoxides and polyesters, to which the acrylic groups are attached.

5. A dyesheet as claimed in any one of claims 1–3, in which the resin comprises an alkyl diacrylate.

6. A dyesheet as claimed in claim 1, wherein the linear organic polymer of component b is selected from polymethylmethacrylate, polyvinyl chloride, linear polyesters and acrylated polyester polyols.

7. A dyesheet as claimed in claim 1, wherein the slip agent is a divalent metal salt of stearic acid.

8. A dyesheet as claimed in claim 1, wherein a single compound is used to provide both slip and antistatic functional components c and d of the coating composition.

9. A dyesheet as claimed in claim 1, having a dye-barrier layer between the dyecoat and the thermoplastic substrate film, said dye-barrier layer restricting the amount of dye moving towards the printer head during the printing process.

10. A dyesheet as claimed in claim 9, wherein the dye-barrier layer comprises the reaction product of polymerising acrylic functional groups in a composition comprising: (a) a polyfunctional organic resin having a plurality of pendant or terminal acrylic groups per molecule available for cross-linking, at least 10% by weight of the polyfunctional resin having 4–8such acrylic functional groups per molecule, and (b) at least one linear organic polymer soluble or partially soluble in the resin, and comprising 1–40% by weight of the resin/polymer mixture.

* * * * *